US011183102B2

(12) United States Patent
Chen et al.

(10) Patent No.: US 11,183,102 B2
(45) Date of Patent: Nov. 23, 2021

(54) SUB-PIXEL UNIT, DISPLAY PANEL, AND DISPLAY APPARATUS AND DRIVE METHOD THEREFOR

(71) Applicants: Beijing BOE Optoelectronics Technology Co., Ltd., Beijing (CN); BOE TECHNOLOGY GROUP CO., LTD., Beijing (CN)

(72) Inventors: Yuxuan Chen, Beijing (CN); Guangquan Wang, Beijing (CN); Xiuyun Chen, Beijing (CN); Zongze He, Beijing (CN); Pin Xiao, Beijing (CN); Yu Zhang, Beijing (CN); Feng Long, Beijing (CN); Jiguo Wang, Beijing (CN); Xiaoyan Yang, Beijing (CN)

(73) Assignees: Beijing BOE Optoelectronics Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/962,614

(22) PCT Filed: Dec. 24, 2019

(86) PCT No.: PCT/CN2019/127945
§ 371 (c)(1),
(2) Date: Jul. 16, 2020

(87) PCT Pub. No.: WO2020/140795
PCT Pub. Date: Jul. 9, 2020

(65) Prior Publication Data

US 2020/0410920 A1 Dec. 31, 2020

(30) Foreign Application Priority Data

Jan. 4, 2019 (CN) ..... 201910009306.6

(51) Int. Cl.
*G09G 3/20* (2006.01)
*G09G 3/3225* (2016.01)
*G09G 3/36* (2006.01)

(52) U.S. Cl.
CPC ..... *G09G 3/2074* (2013.01); *G09G 3/3225* (2013.01); *G09G 3/3648* (2013.01);
(Continued)

(58) Field of Classification Search
CPC .. G09G 3/2074; G09G 3/3225; G09G 3/3607; G09G 3/3648; G09G 2300/0814; G09G 2310/0264
See application file for complete search history.

(56) References Cited

U.S. PATENT DOCUMENTS 8,681,163 B2 * 3/2014 Nakanishi ..... G02F 1/13624 345/530
8,830,436 B2 * 9/2014 Tamaki ..... G02F 1/13624 349/144
(Continued)

FOREIGN PATENT DOCUMENTS

CN 102246222 A 11/2011
CN 103000147 A 3/2013
(Continued)

OTHER PUBLICATIONS

International Search Report and Written Opinion for PCT/CN2019/127945 dated Mar. 25, 2020.
(Continued)

*Primary Examiner* — Gene W Lee
(74) *Attorney, Agent, or Firm* — Thomas | Horstemeyer, LLP

(57) ABSTRACT

The present disclosure provides a sub-pixel unit, a display panel, a display apparatus, and a driving method of the display apparatus, which belongs to the field of display
(Continued)

technology. The sub-pixel unit includes a plurality of sub-pixels; any of the sub-pixels includes a display module, a control module, and a driving module; wherein the control module is connected to a second gate line, a data line, a first voltage end and a first node, and configured to receive a data signal on the data line under control of a signal on the second gate line, and control one of the data line and the first voltage end to be connected to the first node according to the received data signal; and the driving module is connected to a first gate line, the first node and the display module, and configured to drive the display module according to a signal on the first node under control of a signal on the first gate line.

20 Claims, 6 Drawing Sheets

(52) U.S. Cl.
CPC ... *G09G 3/3607* (2013.01); *G09G 2300/0452* (2013.01); *G09G 2300/0814* (2013.01); *G09G 2310/0264* (2013.01)

(56) References Cited

U.S. PATENT DOCUMENTS

| | | | | |
|---|---|---|---|---|
| 9,047,839 | B2 * | 6/2015 | Teranishi | G09G 3/3614 |
| 9,064,446 | B2 * | 6/2015 | Teranishi | G09G 3/2022 |
| 9,384,712 | B2 * | 7/2016 | Teranishi | G09G 3/3607 |
| 9,495,897 | B2 * | 11/2016 | Teranishi | G09G 3/3648 |
| 9,940,887 | B2 * | 4/2018 | Teranishi | G09G 3/3696 |
| 10,078,394 | B2 | 9/2018 | Takano | |
| 10,459,569 | B2 | 10/2019 | Takano | |
| 2006/0221033 | A1 | 10/2006 | Yasuda et al. | |
| 2013/0063499 | A1 | 3/2013 | Tanaka et al. | |
| 2013/0229403 | A1 * | 9/2013 | Teranishi | G09G 3/3648 345/212 |
| 2017/0115810 | A1 | 4/2017 | Takano | |
| 2018/0329571 | A1 | 11/2018 | Takano | |
| 2019/0180706 | A1 * | 6/2019 | Fu | G09G 3/3648 |
| 2019/0295483 | A1 | 9/2019 | Li et al. | |
| 2020/0118494 | A1 * | 4/2020 | Park | G09G 3/3233 |

FOREIGN PATENT DOCUMENTS

| | | | |
|---|---|---|---|
| CN | 106910468 | A | 6/2017 |
| CN | 107610644 | A | 1/2018 |
| CN | 107799089 | A | 3/2018 |
| CN | 108172193 | A | 6/2018 |
| CN | 109389954 | A | 2/2019 |
| CN | 109473079 | A | 3/2019 |
| CN | 109545137 | A | 3/2019 |

OTHER PUBLICATIONS

First Office Action for CN Patent Application No. 201910009306.6 dated Dec. 19, 2019.
Second Office Action for CN Patent Application No. 201910009306.6 dated Jun. 28, 2020.
Decision of Rejection for CN Patent Application No. 201910009306.6 dated Dec. 3, 2020.

* cited by examiner

SUB-PIXEL UNIT, DISPLAY PANEL, AND DISPLAY APPARATUS AND DRIVE METHOD THEREFOR

CROSS-REFERENCE OF RELATED APPLICATION

The present application is a § 371 national phase application of International Application No. PCT/CN2019/127945 filed on Dec. 24, 2019, which claims the benefit of and priority to Chinese Patent Application No. 201910009306.6 filed on Jan. 4, 2019, the contents of which being incorporated by reference in their entireties herein.

TECHNICAL FIELD

The present disclosure relates to the field of display technology and, in particular, to a sub-pixel unit, a display panel, a display apparatus, and a driving method of the display apparatus.

BACKGROUND

The continuous development of display technology and continuous expansion of the application range pose higher requirements on power consumption of the display apparatus. Memory in pixel (MIP) display technology can achieve a low refresh frequency, and thus can have low power consumption.

When MIP display technology is applied, and each pixel of the display apparatus has 3 sub-pixels as an example, each sub-pixel can realize two display forms of a bright state and a dark state, so one pixel can realize conversion of 8 colors.

The above information disclosed in the background section is only for enhancing the understanding of the background of the present disclosure, so it may include information that does not constitute prior art known to those of ordinary skill in the art.

SUMMARY

The present disclosure provides a sub-pixel unit, a display panel, a display apparatus, and a driving method of the display apparatus.

The present disclosure provides following technical solutions.

According to the first aspect of the present disclosure, there is provided a sub-pixel unit, including a plurality of sub-pixels, wherein any one of the sub-pixels includes:

a display sub-circuit;

a control sub-circuit connected to a second gate line, a data line, a first voltage end and a first node, and used to receive a data signal on the data line under control of a signal on the second gate line, and control one of the data line and the first voltage end to be connected to the first node according to the received data signal; and a driving sub-circuit connected to a first gate line, the first node and the display sub-circuit, and used to drive the display sub-circuit according to a signal on the first node under control of a signal on the first gate line.

In an exemplary embodiment of the present disclosure, an amount of the second gate lines is multiple, and control sub-circuits of different sub-pixels are connected to different second gate lines.

In an exemplary embodiment of the present disclosure, the driving sub-circuit is used to drive the display sub-circuit to be in one of a bright state and a dark state; and the display sub-circuits of at least two sub-pixels have different display brightness in the bright state.

In an exemplary embodiment of the present disclosure, the display sub-circuits of at least two sub-pixels have different display areas.

In an exemplary embodiment of the present disclosure, the sub-pixel unit includes:

a first sub-pixel, wherein the display sub-circuit of the first sub-pixel includes a first display sub-circuit and a second display sub-circuit;

a second sub-pixel, wherein the display sub-circuit of the second sub-pixel includes a third display sub-circuit, wherein the first display sub-circuit and the second display sub-circuit are provided on two sides of the third display sub-circuit.

In an exemplary embodiment of the present disclosure, the control sub-circuit includes:

a switching sub-circuit connected to the data line and the second gate line, and used to output the data signal on the data line to a second node under control of the signal on the second gate line;

a latch sub-circuit connected to the second node, a second voltage end, a third voltage end, a third node and a fourth node, and used to output one of a signal on the second voltage end and a signal on the third voltage end to the third node, and output another one of the signal on the second voltage end and the signal on the third voltage end to the fourth node, under control of the second node, the second voltage end and the third voltage end;

a selection sub-circuit connected to the first node, the third node, the fourth node, the data line and the first voltage end, and used to control one of the data line and the first voltage end to be connected to the first node, under control of a signal on the third node and a signal on the fourth node.

In an exemplary embodiment of the present disclosure, the selection sub-circuit includes:

a first selection switch having an input end connected to the data line, an output end connected to the first node, and a control end connected to the third node;

a second selection switch having an input end connected to the first voltage end, an output end connected to the first node, and a control end connected to the fourth node, wherein the first selection switch and the second selection switch are selectively turned on under control of the third node and the fourth node.

In an exemplary embodiment of the present disclosure, the driving sub-circuit includes:

a driving switch having an input end connected to the first node, a control end connected to the first gate line, and an output end connected to the display sub-circuit.

In an exemplary embodiment of the present disclosure, the switching sub-circuit includes a first thin film transistor, and the first thin film transistor has an input end connected to the data line, an output end connected to the latch sub-circuit, and a control end connected to the second gate line.

In an exemplary embodiment of the present disclosure, the latch sub-circuit includes a second thin film transistor, a third thin film transistor, a fourth thin film transistor, and a fifth thin film transistor, wherein the second thin film transistor has one end connected to the second voltage end and the other end connected to a fifth node; the third thin film transistor has one end connected to the fifth node and the other end connected to the third voltage end, control ends of both the second thin film transistor and the third thin film transistor are connected to the second node, the third node and a sixth node, the fourth thin film transistor has one end connected to the second voltage end and the other end connected to the sixth node; the fifth thin film transistor has one end connected to the sixth node and the other end connected to the third voltage end, control ends of both the fourth thin film transistor and the fifth thin film transistor are connected to the fourth node and the fifth node.

In an exemplary embodiment of the present disclosure, the control sub-circuit includes a switching sub-circuit, a latch sub-circuit, and a selection sub-circuit, wherein the switching sub-circuit includes a first thin film transistor, and the first thin film transistor has an input end connected to the data line, an output end connected to the latch sub-circuit, and a control end connected to the second gate line; the latch sub-circuit includes a second thin film transistor, a third thin film transistor, a fourth thin film transistor, and a fifth thin film transistor, wherein the second thin film transistor has one end connected to the second voltage end and the other end connected to a fifth node; the third thin film transistor has one end connected to the fifth node and the other end connected to the third voltage end, control ends of both the second thin film transistor and the third thin film transistor are connected to the second node, the third node and a sixth node, the fourth thin film transistor has one end connected to the second voltage end and the other end connected to the sixth node; the fifth thin film transistor has one end connected to the sixth node and the other end connected to the third voltage end, control ends of both the fourth thin film transistor and the fifth thin film transistor are connected to the fourth node and the fifth node; the selection sub-circuit includes a sixth thin film transistor and a seventh thin film transistor, wherein the sixth thin film transistor has an input end connected to the data line, an output end connected to the first node, and a control end connected to the third node, the seventh thin film transistor has an input end connected to the first voltage end, an output end connected to the first node, and a control end connected to the fourth node; the driving sub-circuit includes an eighth thin film transistor, the eighth thin film transistor has an input end connected to the first node, a control end connected to the first gate line, and an output end connected to the display sub-circuit.

According to the second aspect of the present disclosure, there is provided a display panel, including a first gate line, a second gate line, a data line and a first voltage end, the display panel further including any of the sub-pixel units described above.

According to the third aspect of the present disclosure, there is provided a display apparatus, including a driver and the display panel described above.

According to the fourth aspect of the present disclosure, there is provided a driving method applied to the display apparatus described above, the driving method including:

simultaneously or sequentially driving each of the sub-pixels in one of the sub-pixel units; wherein a method of driving one of the sub-pixels includes:

outputting a signal to the second gate line and outputting a first data signal to the data line, such that the control sub-circuit receives the first data signal under control of the signal on the second gate line, and controls one of the data line and the first voltage end to be connected to the first node according to the first data signal;

outputting a second data signal to the data line, such that the second data signal is output to the first node, or outputting a third data signal to the first voltage end, such that the third data signal is output to the first node; and outputting a signal to the first gate line, such that the driving sub-circuit drives the display sub-circuit according to the signal on the first node under control of the signal on the first gate line.

In an exemplary embodiment of the present disclosure, the second data signal is a gray-scale data signal.

In an exemplary embodiment of the present disclosure, one of the second data signal and the third data signal is used to make the display sub-circuit in a bright state, and the other of the second data signal and the third data signal is used to make the display sub-circuit in a dark state.

It should be understood that the above general description and the following detailed description are only exemplary and explanatory, and do not limit the present disclosure.

This section provides an overview of various implementations or examples of the technology described in this disclosure, and is not a comprehensive disclosure of the full scope or all features of the disclosed technology.

BRIEF DESCRIPTION OF THE DRAWINGS

The above and other features and advantages of the present disclosure will become more apparent by describing example embodiments thereof in detail with reference to the drawings.

DETAILED DESCRIPTION

Figure 1:
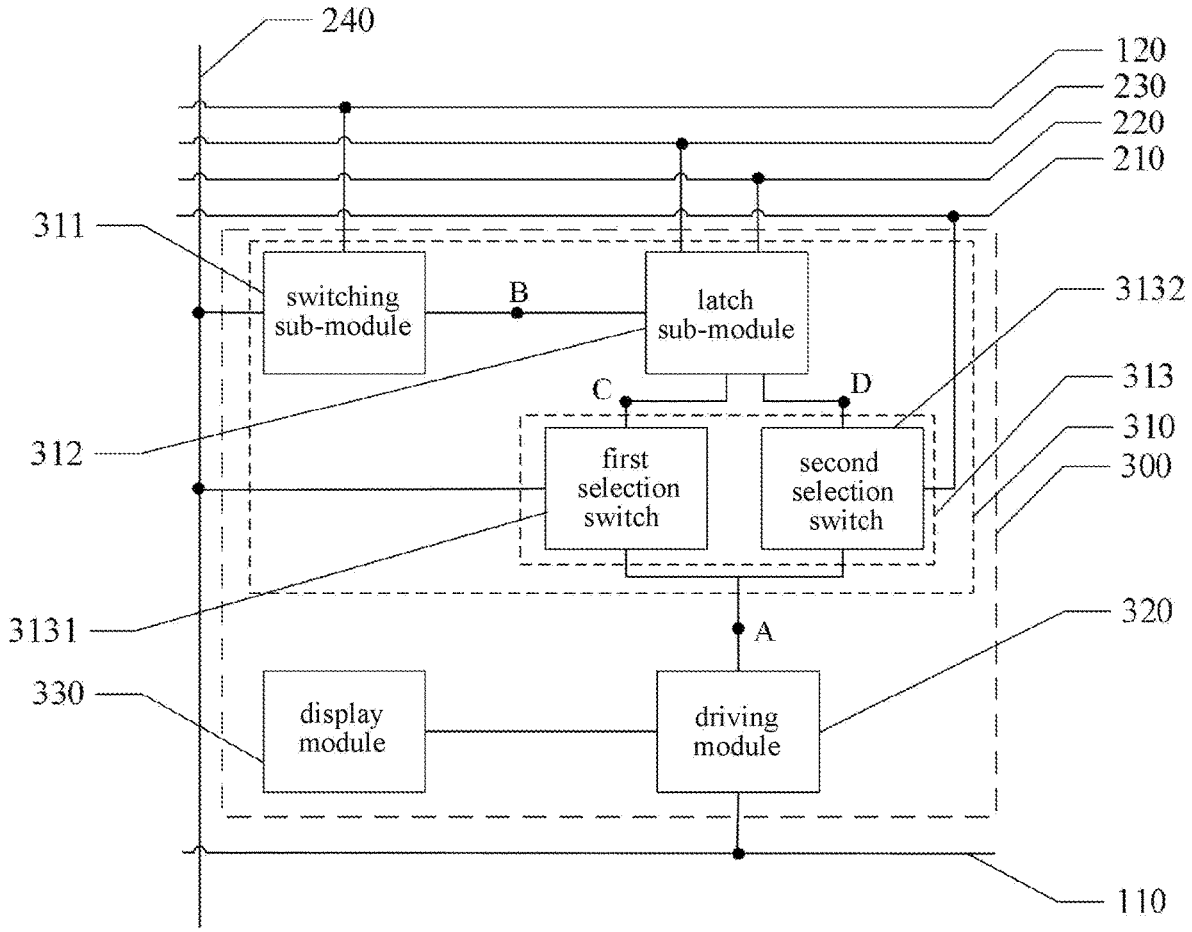
FIG. 1 is a schematic structural diagram of a sub-pixel unit according to an embodiment of the present disclosure.

Example embodiments will now be described more fully with reference to the drawings. However, the example embodiments can be implemented in various forms, and should not be construed as being limited to the examples set forth herein. On the contrary, these embodiments are provided to make the present disclosure more comprehensive and complete, and fully convey the idea of the example embodiments to those skilled in the art. The described features, structures, or characteristics may be combined in one or more embodiments in any suitable manner. In the following description, many specific details are provided to give a full understanding of the embodiments of the present disclosure.

In the drawings, the area and layer thicknesses may be exaggerated for clarity. The same reference numerals in the drawings denote the same or similar structures, and thus their detailed description will be omitted.

When a structure is "on" another structure, it may mean that the structure is integrally formed on the other structure, or that the structure is "directly" arranged on the other structure, or that the structure is "indirectly" arranged on other structures through another structure. The terms "a", "an", "said" are used to indicate presence of one or more elements/components/etc.; the terms "include" and "have"

are used to mean an open-ended inclusion and refer to that there may be additional elements/components or the like in addition to the listed elements/components. The terms "first" and "second" are only used as marks, not to limit the number of objects.

In this disclosure, the term "module" is used to refer to a circuit or a set of circuits configured to perform a specific function, which may include a plurality of circuit elements, and these circuit elements electrically interact with each other to achieve a certain overall function. For example, the display module mentioned below may include a plurality of circuit devices for performing a display (light emitting) function. In one exemplary embodiment, the display module may include an organic light emitting diode having an anode, a cathode, and an organic light emitting layer. When a corresponding electrical signal is applied, a current flows through the organic light emitting diode and causes the organic light emitting layer to emit light. Other modules can also be interpreted in a similar manner, which will not be repeated herein.

An embodiment of the present disclosure provides a sub-pixel unit including a plurality of sub-pixels 300. As shown in FIG. 1, which only shows one sub-pixel 300, and any sub-pixel 300 includes a display module 330, a control module 310 and a driving module 320.

The control module 310 is connected to a second gate line 120, a data line 240, a first voltage end 210 and a first node A, which is used to receive a data signal on the data line 240 under control of a signal on the second gate line 120, and control one of the data line 240 and the first voltage end 210 to be connected to the first node A according to the received data signal. The driving module 320 is connected to a first gate line 110, the first node A and the display module 330, which is used to drive the display module 330 according to a signal on the first node A under control of a signal on the first gate line 110.

In the sub-pixel unit provided by the present disclosure, the control module 310 can selectively connect the data line 240 and the first voltage end 210 to the driving module according to the signal on the data line 240, so that the display module 330 can display under control of the signal on the data line 240 or the signal on the first voltage end 210. Therefore, each sub-pixel 300 may at least have two display states with different display brightness. The sub-pixel unit includes a plurality of sub-pixels 300. According to combination of display states of respective sub-pixels 300, the sub-pixel unit includes a plurality of different display states, and the display brightness of each display state is different, so that the pixel and display apparatus applying this sub-pixel unit can realize the MIP display mode. Not only that, since the first gate line 110 can control turn-on or turn-off of the driving module 320, the data line 240 or the first voltage end 210 can input the gray-scale data signal into the driving module 320 to drive the display module 330, so that the sub-pixel 300 can realize the gray-scale display mode. Therefore, the sub-pixel unit can switch between the MIP display mode and the gray-scale display mode, which expands the number of colors that the sub-pixel unit can display, and thus can expand the application range of the display panel and the display apparatus.

The components of the sub-pixel unit provided in the embodiments of the present disclosure will be described in detail below with reference to the drawings.

Figure 2:
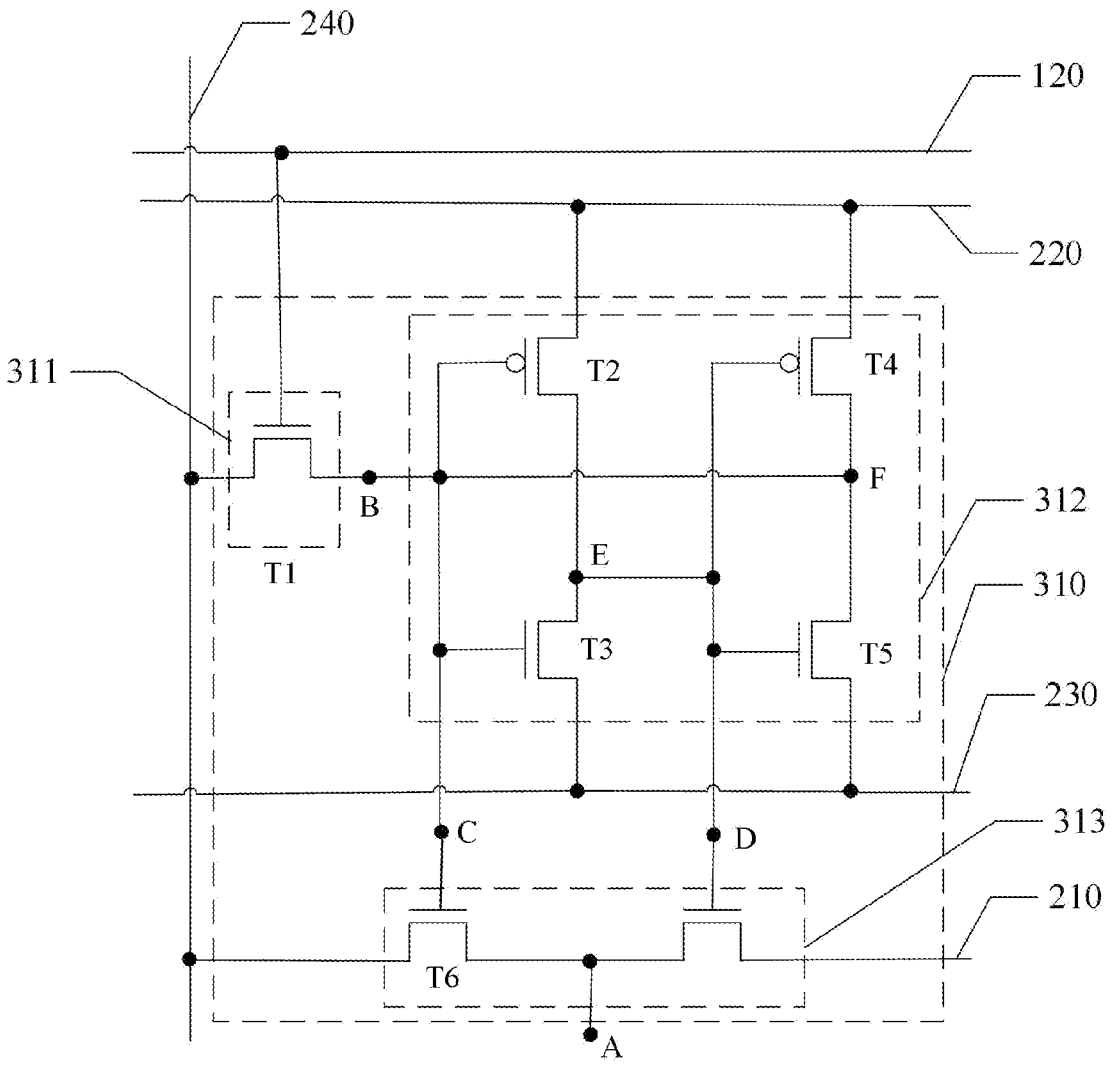
FIG. 2 is a schematic structural diagram of a control module according to an embodiment of the present disclosure.

As shown in FIGS. 1 and 2, the control module 310 may include a switching sub-module 311, a latch sub-module 312, and a selection sub-module 313.

The switching sub-module 311 is connected to the data line 240 and the second gate line 120, and used to output the data signal on the data line 240 to a second node B under control of the signal on the second gate line 120.

The latch sub-circuit 312 is connected to the second node B, a second voltage end 220, a third voltage end 230, a third node C and a fourth node D, and used to output one of a signal on the second voltage end 220 and a signal on the third voltage end 230 to the third node C, and output another one of the signal on the second voltage end 220 and the signal on the third voltage end 230 to the fourth node D, under control of the second node B, the second voltage end 220 and the third voltage end 230.

The selection sub-circuit 230 is connected to the first node A, the third node C, the fourth node D, the data line 240 and the first voltage end 210, and used to control one of the data line 240 and the first voltage end 210 to be connected to the first node A, under control of a signal on the third node C and a signal on the fourth node D.

The switching sub-module 311 may be a transistor, for example, a MOS tube (metal oxide semiconductor field effect transistor) or a triode. Of course, the switching sub-module 311 may also be a combination of a plurality of transistors.

In an embodiment, the switching sub-module 311 may be a first thin film transistor T1. An input end and of the first thin film transistor T1 is connected to the data line 240, an output end of the first thin film transistor T1 is connected to the latch sub-circuit 312, and a control end of the first thin film transistor T1 is connected to the second gate line 120. Under control of the signal on the second gate line 120, the first thin film transistor T1 can be turned on or off. When the first thin film transistor T1 is turned on, the data signal on the data line 240 can be input to the latch sub-module 312.

The latch sub-module 312 may be a latch or a memory. For example, the latch sub-module 312 may be an SRAM (static random access memory) unit.

For example, as shown in FIG. 2, in an embodiment, the latch sub-module 312 may include a second thin film transistor T2, a third thin film transistor T3, a fourth thin film transistor T4, and a fifth thin film transistor T5. The second thin film transistor T2 and the fourth thin film transistor T4 may be P-type MOS transistors, and the third thin film transistor T3 and the fifth thin film transistor T5 may be N-type MOS transistors.

One end of the second thin film transistor T2 may be connected to the second voltage end 220 and the other end of the second thin film transistor T2 may be connected to a fifth node E. One end of the third thin film transistor T3 may be connected to the fifth node E and the other end of the third thin film transistor T3 may be connected to the third voltage end 230. Control ends of both the second thin film transistor T2 and the third thin film transistor T3 may be connected to the second node B, the third node C and a sixth node F.

One end of the fourth thin film transistor T4 may be connected to the second voltage end 220 and the other end of the fourth thin film transistor T4 may be connected to the sixth node F. One end of the fifth thin film transistor T5 may be connected to the sixth node F and the other end of the fifth thin film transistor T5 may be connected to the third voltage end 230. Control ends of both the fourth thin film transistor T4 and the fifth thin film transistor T5 may be connected to the fourth node D and the fifth node E.

The second voltage end 220 may input a high-level signal; and the third voltage end 230 may input a low-level signal. As such, when the first data signal input to the second node B by the data line 240 is at a low level, under control of the low-level signal at the second node B, the second thin film transistor T2 is turned on and the third thin film transistor T3 is turned off, and then, the high-level signal of the second voltage end 220 is input to the fifth node E and the fourth node D. Under control of the high-level signal at the fifth node E, the fourth thin-film transistor T4 is turned off and the fifth thin-film transistor T5 is turned on. Thus, the low-level signal at the third voltage end 230 is input to the second node B, the third node C and sixth node F. In this way, the third node C continuously outputs a low-level signal, and the fourth node D continuously outputs a high-level signal. Similarly, when the first data signal input to the second node B by the data line 240 is at a high level, the third node C continuously outputs a high-level signal, and the fourth node D continuously outputs a low-level signal.

The above only provides a feasible structure of the latch sub-module 312. The technician can adjust the type and connection relationship of respective transistors, the signal of the second voltage end 220 and the signal of the third voltage end 230, etc., to adjust the level of the signal of the third node C and the level of the signal of the fourth node D, so that one of the signals on the third node C and the fourth node D may be at a high level and the other may be at a low level.

As shown in FIG. 1, the selection sub-module 313 may include a first selection switch 3131 and a second selection switch 3132. An input end of the first selection switch 3131 is connected to the data line 240, an output end of the first selection switch 3131 is connected to the first node A, and a control end of the first selection switch 3131 is connected to the third node C. An input end of the second selection switch 3132 is connected to the first voltage end 210, an output end of the second selection switch 3132 is connected to the first node A, and a control end of the second selection switch 3132 is connected to the fourth node D. Under control of the third node C and the fourth node D, the first selection switch 3131 and the second selection switch 3132 are selectively turned on. It can be understood that in an embodiment, when conduction conditions of the first selection switch 3131 and the second selection switch 3132 are the same, for example, when both the first selection switch 3131 and the second selection switch 3132 are turned on at a high level or at a low level, the first selection switch 3131 and the second selection switch 3132 are selectively turned on under control of the third node C and the fourth node D. For example, both the first selection switch 3131 and the second selection switch 3132 may be P-type MOS transistors.

It can be understood that in the embodiment of the present disclosure, one of the control data line 240 and the first voltage end 210 being connected to the first node A means that the first node A and one of the control data line 240 and the first voltage end 210 are conductive. When the data line 240 and the first node A are conductive, it is considered that the data line 240 and the first node A are connected. Similarly, when the first voltage end 210 and the first node A are not conductive, it is considered that the first voltage end 210 and the first node A are not connected.

Figure 3:
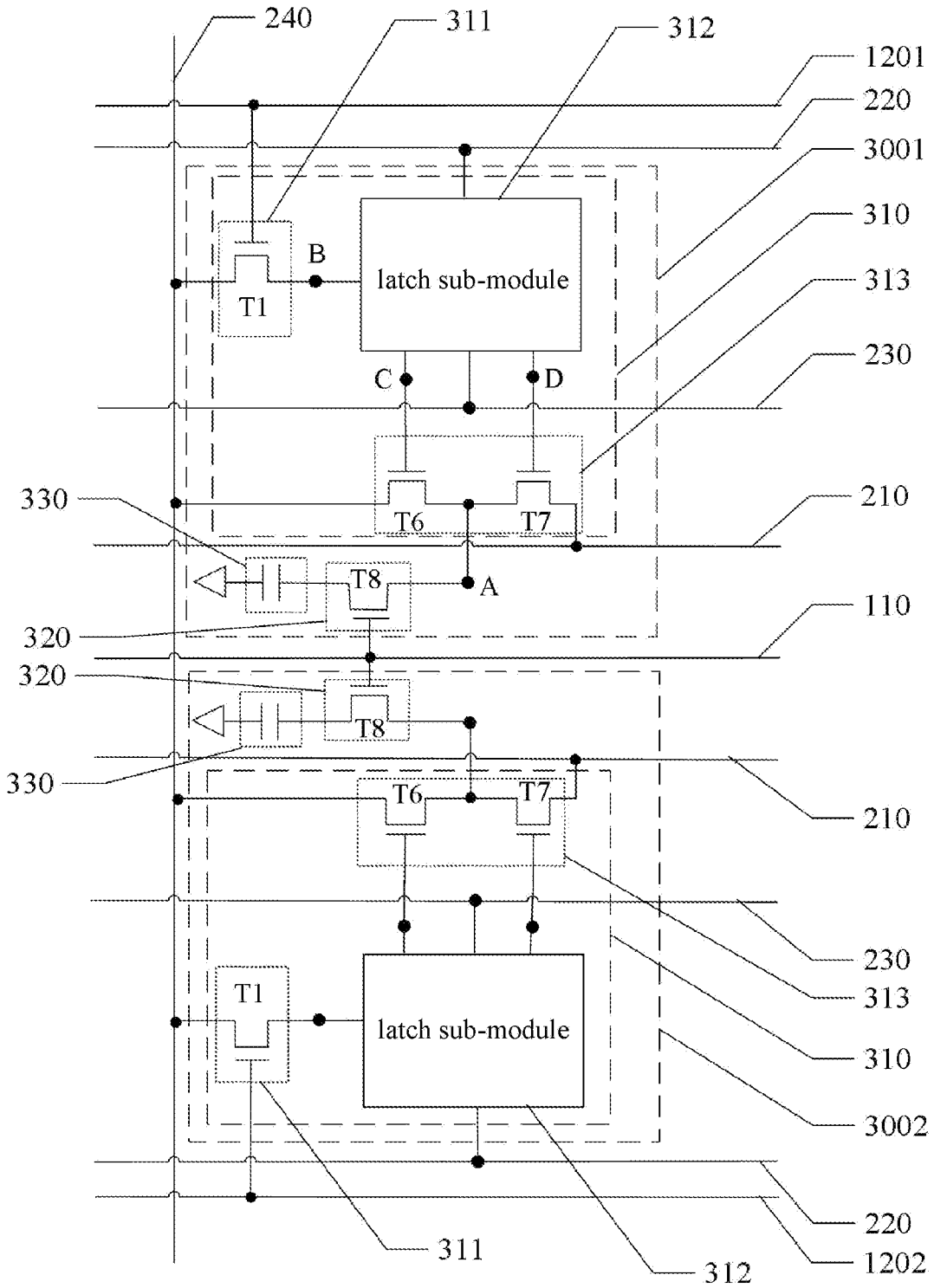
FIG. 3 is a schematic structural diagram of a sub-pixel unit according to an embodiment of the present disclosure.

For example, in one embodiment, as shown in FIGS. 2 and 3, the first selection switch 3131 may be a sixth thin film transistor T6. An input end of the sixth thin film transistor T6 is connected to the data line 240, an output end of the sixth thin film transistor T6 is connected to the first node A, and a control end of the sixth thin film transistor T6 is connected to the third node C. The second selection switch 3132 may be a seventh thin film transistor T7. An input end of the seventh thin film transistor T7 is connected to the first voltage end 210, an output end of the seventh thin film transistor T7 is connected to the first node A, and a control end of the seventh thin film transistor T7 is connected to the fourth node D.

Under control of the third node C and the fourth node D, the sixth thin film transistor T6 and the seventh thin film transistor T7 are selectively turned on. In this way, the signal on the data line 240 and the signal on the first voltage end 210 can be selectively input to the first node A, and the signal on the first node A can be used as the driving signal of the driving module 320.

As shown in FIG. 3, the driving module 320 may include a driving switch. An input end of the driving switch is connected to the first node A, a control end of the driving switch is connected to the first gate line 110, and an output end of the driving switch is connected to the display module 330. The driving switch is turned on under control of the signal on the first gate line 110, so that the signal on the first node A can be input to the display module 330 and drive the display module 330 to perform the display.

In one embodiment, the driving switch may be an eighth thin film transistor T8. One end of the eighth thin film transistor T8 is connected to the first node A, and the other end of the eighth thin film transistor T8 is connected to the display module 330.

The structure of the display module 330 can be selected and determined according to the type of display apparatus to which the sub-pixel unit is applied.

For example, in one embodiment, the display apparatus is an LCD display apparatus, and the display module 330 is a liquid crystal display module 330, which may include a pixel capacitor. One end of the pixel capacitor can be connected to the driving switch, and the other end of the pixel capacitor is connected to a common electrode.

In another embodiment, the display apparatus may be an OLED display apparatus, and then the display module 330 may be an OLED display module 330, which may include a driving electrode. The driving module 320 may further include a driving circuit. The driving circuit may have a storage capacitor and a switching element. The driving electrode may be connected to the switching element, and the switching element may be connected to a power supply. A control end of the switching element may be connected to one end of the storage capacitor, and the other end of the the storage capacitor is connected to the driving switch.

Of course, the above-mentioned driving module 320 and the display module 330 are only a feasible example, and technicians can select different display modules 330 and determine corresponding driving module 320 according to the display module 330, which will not be elaborated one by one in this disclosure.

The driving module 320 may be used to drive the display module 330 to be in one of a bright state and a dark state. In this way, the sub-pixel unit can be displayed in the MIP mode. For example, the second data signal output from the data line 240 to the first node A can be used to control the display module 330 to be in a bright state, and the third data signal output from the first voltage end 210 to the first node A can be used to control the display module 330 to be in a dark state. The magnitudes of the second data signal and the third data signal may be determined according to a specific structure of the display module 330. In one embodiment, one end of the display module 330 may be connected to a common electrode, and the common electrode has a fourth data signal with a square waveform. The second data signal may be a signal reverse to the fourth data signal. That is, when the fourth data signal is a peak value, the second data signal is a base value; when the fourth data signal is a base value, the second data signal is a peak value. In this way, a certain voltage difference can be maintained between the second data signal and the fourth data signal, so that the display module 330 presents a bright state. The third data signal may be the same as the fourth data signal, so that the display module 330 presents a dark state.

In one embodiment, there is a plurality of the second gate lines 120. The control modules 310 of different sub-pixels 300 are connected to different second gate lines 120. In this way, in the same sub-pixel unit, different sub-pixels 300 can be independently controlled by different second gate lines, thereby achieving independent display, such as displaying in a bright state or in a dark state. According to the combination of the bright state or dark state of respective different sub-pixels 300, the sub-pixel unit has a plurality of different MIP display states.

For example, as shown in FIG. 3, the sub-pixel unit includes a first sub-pixel 3001 and a second sub-pixel 3002. The first sub-pixel 3001 is connected to the second gate line A 1201, and the second sub-pixel 3002 is connected to the second gate line B 1202.

The control signal can be output to the second gate line A 1201 at a first moment. The control module 310 of the first sub-pixel 3001 can receive the first data signal on the data line 240 at the first moment according to the control signal on the second gate line A 1201, and then control the first node A of the first sub-pixel 3001 to be conductive with the data line 240 or the first voltage end 210. The control signal may be output to the second gate line B 1202 at a second moment. The control module 310 of the second sub-pixel 3002 may receive the first data signal on the data line 240 at the second moment according to the control signal on the second gate line B 1202, and then control the second node B of the second sub-pixel 3002 to be conductive with the data line 240 or the first voltage end 210. At a third moment, the second data signal may be output to the data line 240, the third data signal may be output to the first voltage end 210, and the control signal may be output to the first gate line 110. As such, the driving module 320 of the first sub-pixel 3001 is turned on and controls the state of the display module 330 according to the second data signal or the third data signal; and the driving module 320 of the second sub-pixel 3002 is turned on and controls the state of the display module 330 according to the second data signal or the third data signal.

By outputting control signals to the second gate line A 1201 and the second gate line B 1202 at different moments, the first sub-pixel 3001 can be in one of the bright state and the dark state, and the second sub-pixel 3002 can also be in one of the bright state and the dark state, so that the sub-pixel unit has a plurality of display states.

In an embodiment, a display brightness of the bright state of the first sub-pixel 3001 and a display brightness of the bright state of the second sub-pixel 3002 are different, and then the sub-pixel unit has three kinds of display brightness. For example, if each pixel includes sub-pixel units of three different colors, the pixel can display 27 colors. In another embodiment, a display brightness of the bright state of the first sub-pixel 3001 and a display brightness of the bright state of the second sub-pixel 3002 are different, and then the sub-pixel unit has four kinds of display brightness. For example, if each pixel includes sub-pixel units of three different colors, the pixel can display 64 colors.

It can be understood that when the number of sub-pixels 300 in the sub-pixel unit is greater, and each sub-pixel 300 can be independently controlled and has different display brightness in the bright state, the sub-pixel 300 may have more display states, and correspondingly, the pixel can display more colors. For example, when a sub-pixel unit has three sub-pixels 300 that independently emit light and have different display brightness in the bright state, according to the MIP display mode, the sub-pixel unit can have up to 8 display modes; a pixel with 3 sub-pixel units can display up to 512 colors.

Of course, in another embodiment, the control signals may be output to the second gate line A 1201 and the second gate line B 1202 at the same time, so that the first sub-pixel 3001 and the second sub-pixel 3002 are in the same bright state or dark state, and the sub-pixel unit only has two MIP display states of a bright state or a dark state. When there are three different sub-pixel units in a pixel, the pixel can display 8 different colors.

Therefore, when operating in the MIP display mode, the sub-pixel unit provided by the present disclosure can simultaneously control each sub-pixel 300 to be in a bright state or a dark state at the same time, thereby making the corresponding pixels have fewer display colors, for example, making RGB pixels display 8 colors. It is also possible to control the sub-pixels 300 at different times and thus each sub-pixel 300 can be independently in a dark state or a bright state, so that the corresponding pixels have more display colors, for example, RGB pixels can display 64 colors. Therefore, the sub-pixel unit enables the pixel and the display apparatus to which the sub-pixel unit is applied to switch between different MIP modes, and switch to a MIP display mode with a lower number of colors in an environment that does not require high image quality, so as to reduce power consumption for refreshing the pixels.

The display brightness in the bright state of the two display modules 330 may be different through various different methods. For example, it may be achieved by adjusting the display area and number of the display module 330.

In one embodiment, display areas of the display modules 330 of at least two sub-pixels 300 are different. The difference in display area will lead to the difference in display brightness in the bright state of the display module 330.

In another embodiment, each sub-pixel 300 may include at least one display module 330, and the display area of each display module 330 may be the same; the number of display modules 330 in different sub-pixels 300 may be different, so that the display areas of each sub-pixel 300 are different, and then the display brightness in the bright state of each sub-pixel 300 is different.

Figure 4A:
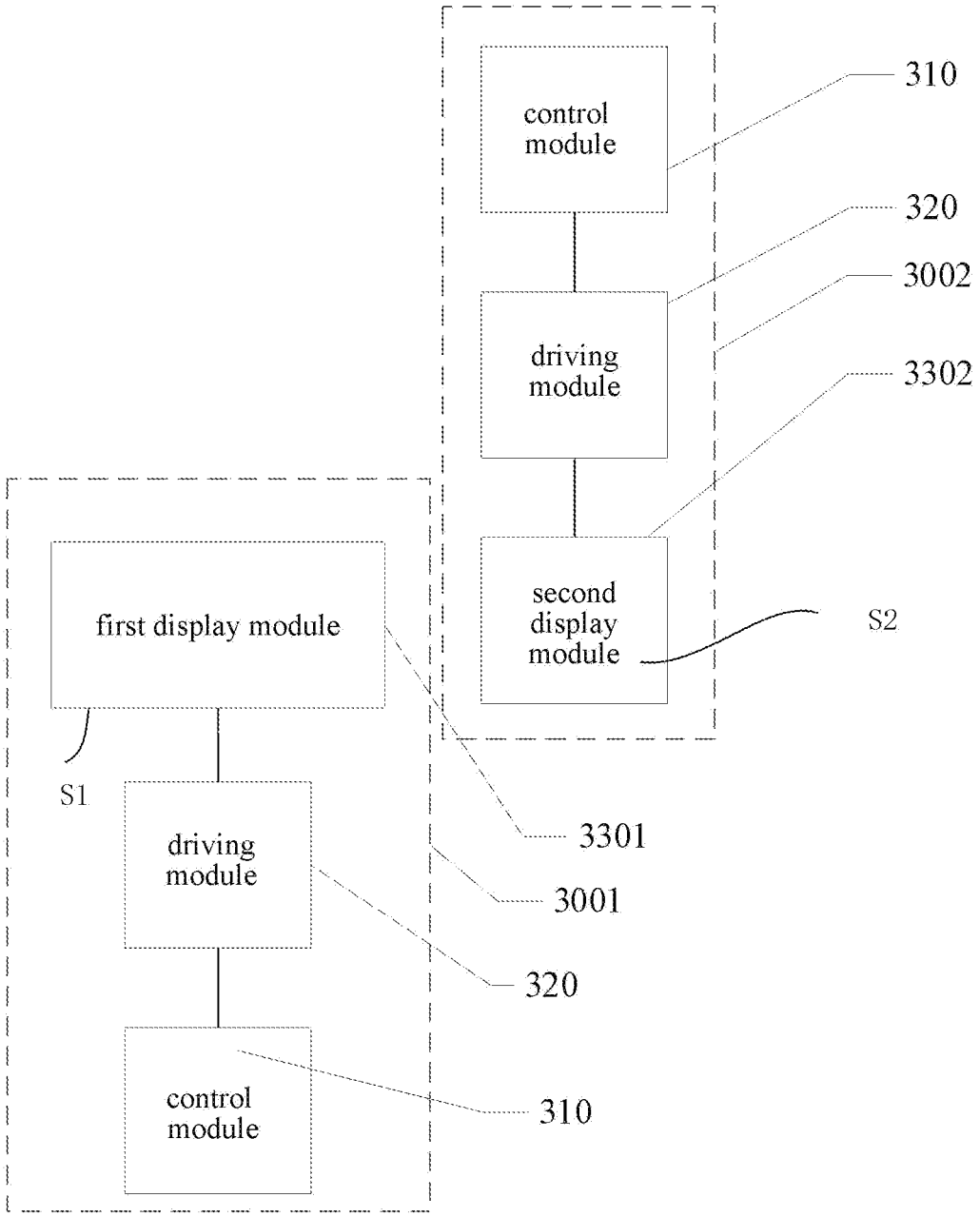
FIGS. 4A and 4B are schematic structural diagrams of sub-pixel units according to an embodiment of the present disclosure.

For example, as shown in FIG. 4A, the sub-pixel unit includes a first sub-pixel 3001 and a second sub-pixel 3002. The display module 330 of the first sub-pixel 3001 includes the first display module 3301; and the display module 330 of the second sub-pixel 3002 includes a second display module 3302. The first display module 3301 and the second display module 3302 may have light emitting areas with areas S1 and S2, respectively, and the area S1 is larger than the area S2.

Figure 4B:
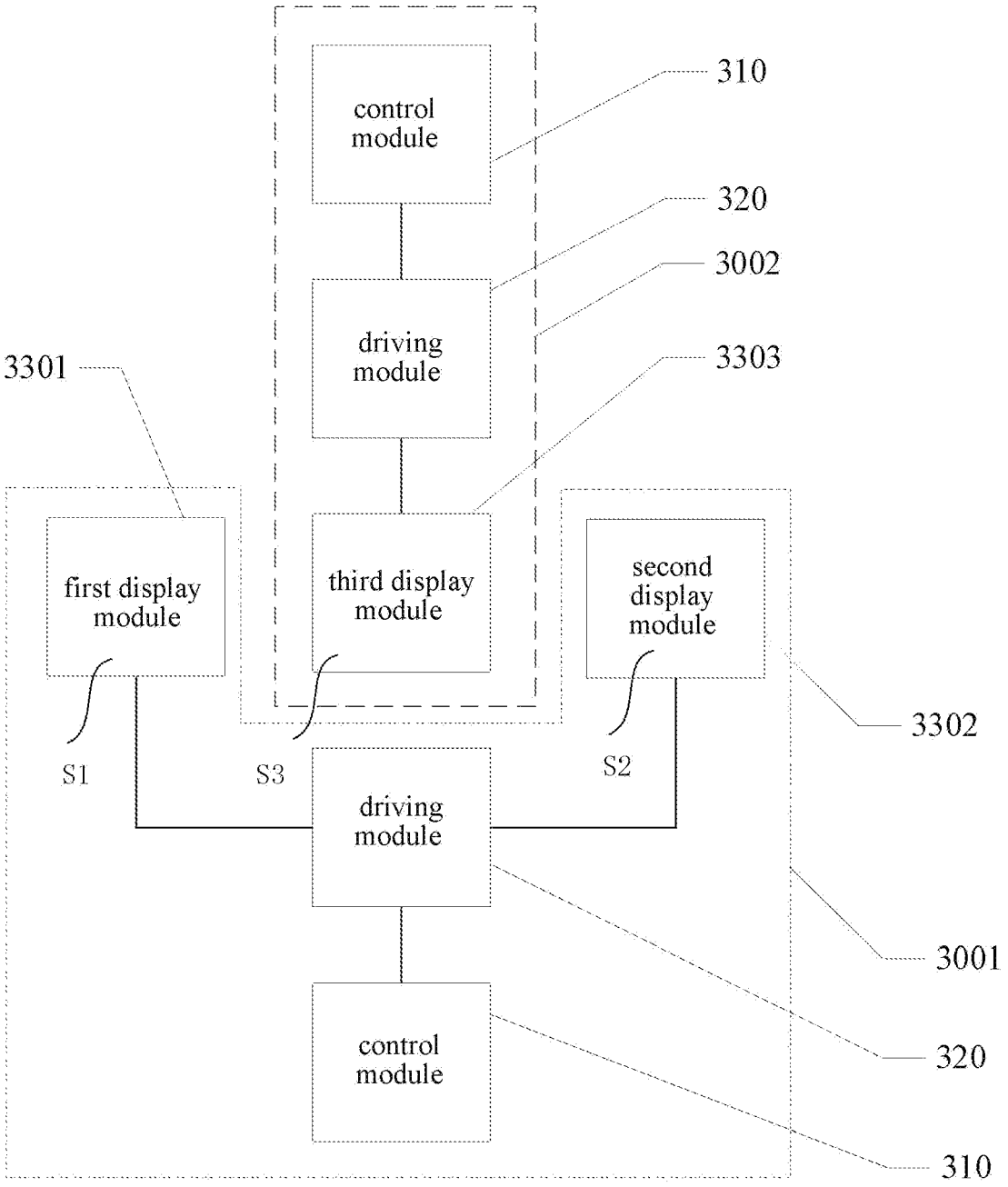

For example, as shown in FIG. 4B, the sub-pixel unit includes a first sub-pixel 3001 and a second sub-pixel 3002. The display module 330 of the first sub-pixel 3001 includes a first display module 3301 and a second display module 3302; and the display module 330 of the second sub-pixel 3002 includes a third display module 3303. The first display module 3301 and the second display module 3302 may be disposed at two sides of the third display module 3303. In this way, not only the display brightness of the first sub-pixel 3001 and the second sub-pixel 3002 are different, but also the display of the sub-pixel units can be more uniform.

As shown in FIG. 4B, the first display module 3301, the second display module 3302, and the third display module 3303 may have light emitting areas with areas S1, S2, and S3, respectively, and the areas S1, S2, and S3 may be substantially the same. Therefore, the first sub-pixel 3001 may have a light emitting area that is twice as large as that of the second sub-pixel 3002, and thus can achieve different display brightness. Compared with the embodiment of FIG. 4A, since the light emitting area of the first sub-pixel 3001 is more dispersed, the concentration of light emission is avoided, thereby making the display of the pixel unit more uniform. It should be understood that the present disclosure is not limited to this, the number of display modules included in each pixel unit shown in the drawing is only schematic, and according to specific needs, the first sub-pixel 3001 and the second sub-pixel 3002 of the present disclosure may include display modules of other numbers. As long as they are of different numbers, the purpose of the present disclosure can be achieved. In addition, the areas of the respective display modules are not limited to be substantially the same as each other, as long as the sum of the light emitting areas of the display modules included in the first sub-pixel 3001 and the second sub-pixel 3002 are different from each other, the purpose of the present disclosure can be achieved.

The sub-pixel unit can also be displayed in a gray-scale mode, thereby achieving the switch between the MIP display mode and the gray-scale display mode. When the sub-pixel unit is displayed in the gray-scale mode, the gray-scale data signal may be input to the first node A, and under control of the first gate line 110, the driving module 320 may drive the display module 330 to display according to the gray-scale data signal. The gray-scale data signal may be a second data signal or a third data signal. Since the first gate line 110 controls the driving module 320, the gray-scale data signals can be sequentially input and stored in a plurality of different sub-pixel units through the control of the first gate line 110, so that the plurality of different sub-pixel units can be displayed in the gray-scale mode.

For example, as shown in FIG. 3, at the first moment, the first data signal can be output to the data line 240, so that the first node A and the data line 240 are conductive. At the second moment, the second data signal can be output to the data line 240, and the second data signal is a gray-scale data signal. At a third moment, a control signal can be output to the first gate line 110, so that the driving module 320 and the first node A are conductive, and the display module 330 is driven under control of the second data signal.

The sub-pixel unit can multiplex the data line 240 and control the driving module 320 by the first gate line 110, so that the signal on the data line 240 can be used to control the control module 310, drive the display module 330 to present in a bright state or a dark state (MIP display), and drive the display module 330 to perform gray-scale display. In this way, in application scenarios requiring high image quality, the pixel and the display apparatus to which the sub-pixel unit is applied can be displayed in a gray-scale mode. For example, each display module 330 can display 256 kinds of different display brightness, so that the pixels and display panel can display richer colors and high-quality pictures.

The present disclosure further provides a display panel, which may include a first gate line 110, a second gate line 120, a data line 240, and a first voltage end 210. The display panel further includes the sub-pixel units described in the above-mentioned sub-pixel unit embodiments. The display panel may be an LCD, OLED, or other display panel.

The sub-pixel unit used in the display panel of the embodiment of the present disclosure is the same as the sub-pixel unit in the above-mentioned sub-pixel unit embodiments, therefore, it has the same beneficial effects, which will not be repeated herein.

The present disclosure further provides a display apparatus, which may include the display panel described in the above display panel embodiments. The display apparatus may be a television, a mobile phone screen, a computer monitor, a smart watch display screen, a meter display screen, or an electronic billboard, etc., which is not specifically limited in this disclosure.

Figure 6:
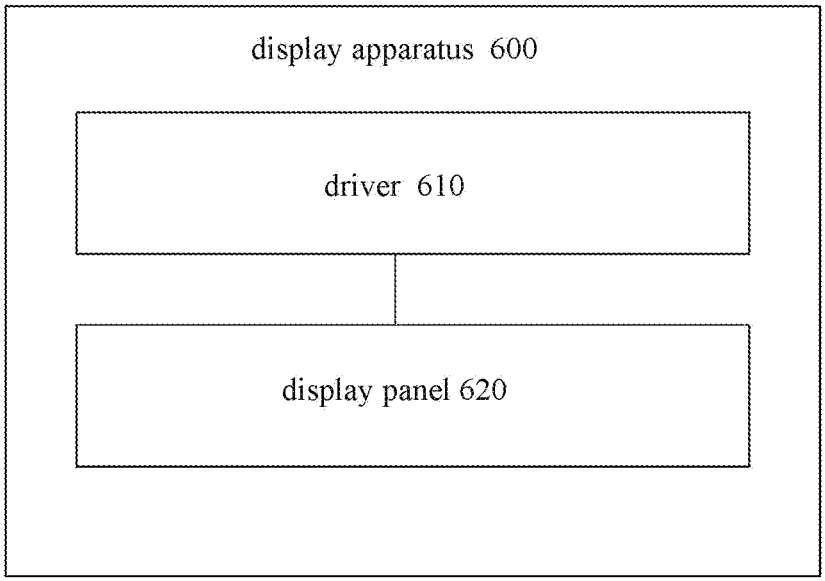
FIG. 6 is a schematic structural diagram of a display apparatus according to an embodiment of the present disclosure.

FIG. 6 is a schematic structural diagram of a display apparatus according to an embodiment of the present disclosure. Referring to FIG. 6, the display apparatus 600 may include a driver 610 and a display panel 620. The driver 610 is configured to perform the method of driving the display panel as described in an exemplary embodiment of the present disclosure, to drive the display panel. The driver 610 may include a circuit structure such as a processor, a logic circuit, and the like. There have been various drivers and/or drive circuit structures that can be used to provide a driving signal involved in the driving method of the present disclosure in the related art, and descriptions will not be repeated herein. The display panel 620 may include a display panel as described in an exemplary embodiment of the present disclosure, which may include a first gate line, a second gate line, a data line, a first voltage end, and a sub-pixel unit as described in an exemplary embodiment of the present disclosure. The specific structure of each component included in the display panel 620 may refer to the foregoing embodiments of the present disclosure and the corresponding drawings, and thus will not be repeated herein.

The display panel adopted by the display apparatus according to the embodiment of the present disclosure is the same as the display panel in the above-mentioned display panel embodiments, and therefore has the same beneficial effects, which will not be repeated herein.

The present disclosure further provides a driving method of a display apparatus. The display apparatus may be the display apparatus described in the above display apparatus embodiments. The driving method includes following steps.

Figure 5:
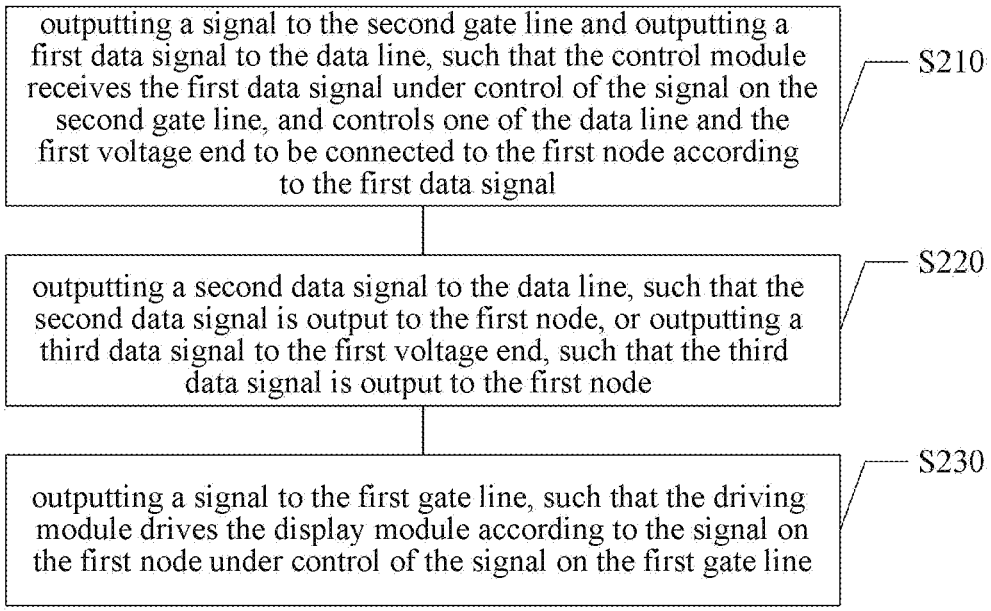
FIG. 5 is a schematic flowchart of driving one sub-pixel in an embodiment of the present disclosure.

In step S100, each of the sub-pixels 300 in one of the sub-pixel units is driven simultaneously or sequentially. As shown in FIG. 5, a method of driving one of the sub-pixels 300 includes:

in step S210, outputting a signal to the second gate line 120 and outputting a first data signal to the data line 240, such that the control module 310 receives the first data signal under control of the signal on the second gate line 120, and control one of the data line 240 and the first voltage end 210 to be connected to the first node A according to the first data signal;

in step S220, outputting a second data signal to the data line 240, such that the second data signal is output to the first node A, or outputting a third data signal to the first voltage end 210, such that the third data signal is output to the first node A; and in step S230, outputting a signal to the first gate line 110, such that the driving module 320 drives the display module 330 according to the signal on the first node A under control of the signal on the first gate line 110.

In the embodiment, simultaneously driving each sub-pixel 300 in one sub-pixel unit means that each sub-pixel 300 in one sub-pixel unit performs the step S210 at the same time. That is, a control signal is output to the second gate line 120 corresponding to each sub-pixel 300 at the same time, such that the control module 310 of each sub-pixel 300 receives the first data signal at the same time. As such, the first node A of each sub-pixel 300 turns on the data line 240 or the first voltage end 210.

In an embodiment, one of the second data signal and the third data signal is used to make the display module 330 in a bright state, and the other of the second data signal and the third data signal is used to make the display module 330 in a dark state, and then each sub-pixel 300 may have the same display state, that is, both in the bright state or both in the dark state. Therefore, the sub-pixel unit may have two states of a bright state or a dark state. At this time, the display apparatus can operate according to the MIP display mode, and the display apparatus can have fewer display colors.

In another embodiment, in step S220, one of the second data signal and the third data signal may be a gray-scale data signal. In this way, the display apparatus can work according to the gray-scale display mode.

Sequentially driving each sub-pixel 300 in one sub-pixel unit means that each sub-pixel 300 in the sub-pixel unit performs the step S210 at different moments. That is, a control signal is output to the second gate line corresponding to each sub-pixel 300 sequentially, such that the control module 310 of each sub-pixel 300 receives the first data signal from the data line 240 at different moments. Since the first data signal can be different at different moments, the driving module 320 of each sub-pixel 300 can independently select to conduct with the data line 240 or the first voltage end 210. In step S220, one of the second data signal and the third data signal is used to make the display module 330 in a bright state, and the other of the second data signal and the third data signal is used to make the display module 330 in a dark state. As such, each sub-pixel 300 may independently be in a bright state or a dark state. The sub-pixel unit may have many different display states. In this way, the display apparatus works according to the MIP display mode, and can have more display colors.

According to the sub-pixel unit, the display panel, the display apparatus and the driving method of the display apparatus provided by the present disclosure, the control module can selectively connect the data line and the first voltage end with the driving module according to the signal on the data line, so that the display module can be displayed under control of the signal on the data line or the signal on the first voltage end. Therefore, each sub-pixel may have at least two display states with different display brightness. The sub-pixel unit includes a plurality of sub-pixels. According to combination of the display states of respective sub-pixels, the sub-pixel unit includes a plurality of different display states, and the display brightness of each display state is different, so that the pixel and the display apparatus to which the sub-pixel unit is applied can realize the MIP display mode. Not only that, since the first gate line can control turn-on or turn-off of the driving module, the data line or the first voltage end can input the gray-scale data signal into the driving module to drive the display module, thereby making the sub-pixel achieve the gray-scale display mode. Therefore, the sub-pixel unit can switch between the MIP display mode and the gray-scale display mode, which expands the number of colors that the sub-pixel unit can display, and thus can expand the application range of the display panel and the display apparatus.

It should be noted that although the steps of the method in the present disclosure are described in a specific order in the drawings, this does not require or imply that the steps must be performed in the specific order, or all the steps shown must be performed to achieve the desired result. Additionally or alternatively, certain steps may be omitted, multiple steps may be combined into one step for execution, and/or one step may be decomposed into multiple steps for execution, etc., all of which shall be considered as part of the present disclosure.

It should be understood that this disclosure does not limit its application to the detailed structure and arrangement of the components proposed in this specification. The present disclosure can have other embodiments, and can be implemented and executed in various ways. The aforementioned modified forms and amended forms fall within the scope of the present disclosure. It should be understood that the disclosure disclosed and defined in this specification extends to all alternative combinations of two or more individual features mentioned or evident in the text and/or drawings. All of these different combinations constitute various alternative aspects of the present disclosure. The embodiments described in this specification illustrate the best modes known for implementing the present disclosure, and will enable those skilled in the art to utilize the present disclosure.

What is claimed is:

1. A sub-pixel unit, comprising a plurality of sub-pixels, wherein any one of the sub-pixels comprises:

a display sub-circuit;

a control sub-circuit connected to a second gate line, a data line, a first voltage end, and a first node, and configured to receive a data signal on the data line under control of a signal on the second gate line, and control one of the data line and the first voltage end to be connected to the first node according to the received data signal; and a driving sub-circuit connected to a first gate line, the first node, and the display sub-circuit, and configured to drive the display sub-circuit according to a signal on the first node under control of a signal on the first gate line, wherein the driving sub-circuit is configured to drive the display sub-circuit to be in one of a bright state and a dark state; and the display sub-circuits of at least two sub-pixels have different display brightness in the bright state.

2. The sub-pixel unit according to claim 1, wherein the second gate line is one of a plurality of second gate lines, and control sub-circuits of different sub-pixels are connected to different ones of the plurality of second gate lines.

3. The sub-pixel unit according to claim 1, wherein the first gate line is one of a plurality of first gate lines, and driving sub-circuits of adjacent sub-pixels are connected to the same one of the first gate lines.

4. The sub-pixel unit according to claim 1, wherein the display sub-circuits of at least two sub-pixels have different display areas.

5. The sub-pixel unit according to claim 1, wherein the sub-pixel unit comprises:

a first sub-pixel, wherein the display sub-circuit of the first sub-pixel comprises a first display sub-circuit and a second display sub-circuit; and a second sub-pixel, wherein the display sub-circuit of the second sub-pixel comprises a third display sub-circuit, wherein the first display sub-circuit and the second display sub-circuit are provided on two sides of the third display sub-circuit.

6. The sub-pixel unit according to claim 1, wherein the control sub-circuit comprises:

a switching sub-circuit connected to the data line and the second gate line, and configured to output the data signal on the data line to a second node under control of the signal on the second gate line;

a latch sub-circuit connected to the second node, a second voltage end, a third voltage end, a third node, and a fourth node, and configured to output one of a signal on the second voltage end and a signal on the third voltage end to the third node, and output another one of the signal on the second voltage end and the signal on the third voltage end to the fourth node, under control of the second node, the second voltage end, and the third voltage end;

a selection sub-circuit connected to the first node, the third node, the fourth node, the data line, and the first voltage end, and configured to control one of the data line and the first voltage end to be connected to the first node, under control of a signal on the third node and a signal on the fourth node.

7. The sub-pixel unit according to claim 6, wherein the selection sub-circuit comprises:

a first selection switch having an input end connected to the data line, an output end connected to the first node, and a control end connected to the third node; and a second selection switch having an input end connected to the first voltage end, an output end connected to the first node, and a control end connected to the fourth node, wherein the first selection switch and the second selection switch are selectively turned on under control of the third node and the fourth node.

8. The sub-pixel unit according to claim 6, wherein the switching sub-circuit comprises a first thin film transistor, and the first thin film transistor has an input end connected to the data line, an output end connected to the latch sub-circuit, and a control end connected to the second gate line.

9. The sub-pixel unit according to claim 6, wherein:

the latch sub-circuit comprises a second thin film transistor, a third thin film transistor, a fourth thin film transistor, and a fifth thin film transistor;

the second thin film transistor has one end connected to the second voltage end and the other end connected to a fifth node;

the third thin film transistor has one end connected to the fifth node and the other end connected to the third voltage end;

control ends of both the second thin film transistor and the third thin film transistor are connected to the second node, the third node, and a sixth node;

the fourth thin film transistor has one end connected to the second voltage end and the other end connected to the sixth node;

the fifth thin film transistor has one end connected to the sixth node and the other end connected to the third voltage end; and control ends of both the fourth thin film transistor and the fifth thin film transistor are connected to the fourth node and the fifth node.

10. The sub-pixel unit according to claim 1, wherein the driving sub-circuit comprises a driving switch having an input end connected to the first node, a control end connected to the first gate line, and an output end connected to the display sub-circuit.

11. The sub-pixel unit according to claim 1, wherein:

the control sub-circuit comprises a switching sub-circuit, a latch sub-circuit, and a selection sub-circuit;

the switching sub-circuit comprises a first thin film transistor, and the first thin film transistor has an input end connected to the data line, an output end connected to the latch sub-circuit, and a control end connected to the second gate line;

the latch sub-circuit comprises a second thin film transistor, a third thin film transistor, a fourth thin film transistor, and a fifth thin film transistor;

the second thin film transistor has one end connected to the second voltage end and the other end connected to a fifth node;

the third thin film transistor has one end connected to the fifth node and the other end connected to the third voltage end, control ends of both the second thin film transistor and the third thin film transistor are connected to the second node, the third node and a sixth node, the fourth thin film transistor has one end connected to the second voltage end and the other end connected to the sixth node;

the fifth thin film transistor has one end connected to the sixth node and the other end connected to the third voltage end, control ends of both the fourth thin film transistor and the fifth thin film transistor are connected to the fourth node and the fifth node;

the selection sub-circuit comprises a sixth thin film transistor and a seventh thin film transistor, wherein the sixth thin film transistor has an input end connected to the data line, an output end connected to the first node, and a control end connected to the third node, the seventh thin film transistor has an input end connected to the first voltage end, an output end connected to the first node, and a control end connected to the fourth node; and the driving sub-circuit comprises an eighth thin film transistor, the eighth thin film transistor having an input end connected to the first node, a control end connected to the first gate line, and an output end connected to the display sub-circuit.

12. A display panel, comprising:

a first gate line, a second gate line, a data line, a first voltage end, and a sub-pixel unit, wherein the sub-pixel unit comprises a plurality of sub-pixels, and any one of the sub-pixels comprises:

a display sub-circuit;

a control sub-circuit connected to the second gate line, the data line, the first voltage end, and a first node, and configured to receive a data signal on the data line under control of a signal on the second gate line, and control one of the data line and the first voltage end to be connected to the first node according to the received data signal; and a driving sub-circuit connected to the first gate line, the first node, and the display sub-circuit, and configured to drive the display sub-circuit according to a signal on the first node under control of a signal on the first gate line, wherein the driving sub-circuit is configured to drive the display sub-circuit to be in one of a bright state and a dark state; and the display sub-circuits of at least two sub-pixels have different display brightness in the bright state.

13. The display panel according to claim 12, wherein the display panel is implemented in a display apparatus.

14. A driving method applied to the display apparatus according to claim 13, the driving method comprising:

simultaneously or sequentially driving each of the sub-pixels in one of the sub-pixel units; wherein a method of driving one of the sub-pixels comprises:

outputting a signal to the second gate line and outputting a first data signal to the data line, such that the control sub-circuit receives the first data signal under control of the signal on the second gate line, and controls one of the data line and the first voltage end to be connected to the first node according to the first data signal;

outputting a second data signal to the data line, such that the second data signal is output to the first node, or outputting a third data signal to the first voltage end, such that the third data signal is output to the first node; and outputting a signal to the first gate line, such that the driving sub-circuit drives the display sub-circuit according to the signal on the first node under control of the signal on the first gate line.

15. The driving method according to claim 14, wherein the second data signal is a gray-scale data signal.

16. The driving method according to claim 14, wherein one of the second data signal and the third data signal is configured to make the display sub-circuit in a bright state, and the other of the second data signal and the third data signal is configured to make the display sub-circuit in a dark state.

17. A sub-pixel unit, comprising:

a plurality of sub-pixels, wherein any one of the sub-pixels comprises:

a display sub-circuit;

a control sub-circuit connected to a second gate line, a data line, a first voltage end, and a first node, and configured to receive a data signal on the data line under control of a signal on the second gate line, and control one of the data line and the first voltage end to be connected to the first node according to the received data signal;

a driving sub-circuit connected to a first gate line, the first node, and the display sub-circuit, and configured to drive the display sub-circuit according to a signal on the first node under control of a signal on the first gate line;

a first sub-pixel, wherein the display sub-circuit of the first sub-pixel comprises a first display sub-circuit and a second display sub-circuit; and a second sub-pixel, wherein the display sub-circuit of the second sub-pixel comprises a third display sub-circuit, wherein the first display sub-circuit and the second display sub-circuit are provided on two sides of the third display sub-circuit.

18. The sub-pixel unit according to claim 17, wherein the control sub-circuit comprises:

a switching sub-circuit connected to the data line and the second gate line, and configured to output the data signal on the data line to a second node under control of the signal on the second gate line;

a latch sub-circuit connected to the second node, a second voltage end, a third voltage end, a third node, and a fourth node, and configured to output one of a signal on the second voltage end and a signal on the third voltage end to the third node, and output another one of the signal on the second voltage end and the signal on the third voltage end to the fourth node, under control of the second node, the second voltage end, and the third voltage end;

a selection sub-circuit connected to the first node, the third node, the fourth node, the data line, and the first voltage end, and configured to control one of the data line and the first voltage end to be connected to the first node, under control of a signal on the third node and a signal on the fourth node.

19. The sub-pixel unit according to claim 18, wherein the selection sub-circuit comprises:

a first selection switch having an input end connected to the data line, an output end connected to the first node, and a control end connected to the third node; and a second selection switch having an input end connected to the first voltage end, an output end connected to the first node, and a control end connected to the fourth node, wherein the first selection switch and the second selection switch are selectively turned on under control of the third node and the fourth node.

20. The sub-pixel unit according to claim 17, wherein the driving sub-circuit comprises a driving switch having an input end connected to the first node, a control end connected to the first gate line, and an output end connected to the display sub-circuit.

* * * * *